US010953448B2

(12) United States Patent
Lan

(10) Patent No.: US 10,953,448 B2
(45) Date of Patent: Mar. 23, 2021

(54) METHOD AND DEVICE FOR BENDING PIPE

(71) Applicant: SANOH INDUSTRIAL CO., LTD., Tokyo (JP)

(72) Inventor: Guang Ping Lan, Ibaraki (JP)

(73) Assignee: SANOH INDUSTRIAL CO., LTD., Tokyo (JP)

( * ) Notice: Subject to any disclaimer, the term of this patent is extended or adjusted under 35 U.S.C. 154(b) by 459 days.

(21) Appl. No.: 15/566,479

(22) PCT Filed: Apr. 25, 2016

(86) PCT No.: PCT/JP2016/062943
§ 371 (c)(1),
(2) Date: Oct. 13, 2017

(87) PCT Pub. No.: WO2016/199511
PCT Pub. Date: Dec. 15, 2016

(65) Prior Publication Data

US 2018/0126436 A1 May 10, 2018

(30) Foreign Application Priority Data

Jun. 12, 2015 (JP) ..... JP2015-118775

(51) Int. Cl.
*B21D 7/024* (2006.01)
*B21D 7/12* (2006.01)
(Continued)

(52) U.S. Cl.
CPC ..... *B21D 7/024* (2013.01); *B21D 7/12* (2013.01); *B21D 7/14* (2013.01); *B21D 7/16* (2013.01)

(58) Field of Classification Search
CPC . B21D 7/024; B21D 7/12; B21D 7/14; B21D 7/16; B21D 7/08; B21D 9/05;
(Continued)

(56) References Cited

U.S. PATENT DOCUMENTS 6,134,932 A * 10/2000 Marque ..... B21D 7/024 72/149
6,782,728 B2 * 8/2004 Latour ..... B21D 7/022 72/217
(Continued)

FOREIGN PATENT DOCUMENTS

JP 2012-30266 A 2/2012
JP 2014-94393 A 5/2014

*Primary Examiner* — Debra M Sullivan
*Assistant Examiner* — Matthew Kresse
(74) *Attorney, Agent, or Firm* — Posz Law Group, PLC

(57) ABSTRACT

A method for bending a pipe by, while sandwiching one portion of the pipe by a gripping device, sandwiching the other portion of the pipe between a pair of bending rolls and by causing the other bending roll to relatively revolve about one bending roll out of the pair of bending rolls, wherein the bending rolls are held by a common movable frame body, the relative revolution is realized by synchronous movement in which rotating movement for rotating the frame body and lateral movement for moving the frame body in a direction (Y-axis direction) perpendicular to a longitudinal direction (X-axis direction) of the pipe are synchronized with each other, and the movement in the Y-axis direction of the frame body is performed such that a position in the Y-axis direction of a center axis of the one bending roll is held and a position in the X-axis direction of a rotating center point of the rotating movement remains same.

7 Claims, 7 Drawing Sheets

(51) Int. Cl.
*B21D 7/14* (2006.01)
*B21D 7/16* (2006.01)

(58) Field of Classification Search
CPC ..... B21D 11/07; B21D 11/12; B21D 7/02; B21D 7/022; B21D 7/04; B21D 7/085; B21D 7/10; B21D 9/07; B21D 9/076; B21D 11/06; B21D 11/10
USPC ..... 72/149, 153, 157
See application file for complete search history.

(56) References Cited

U.S. PATENT DOCUMENTS

| | | | | |
|---|---|---|---|---|
| 6,813,922 | B2 * | 11/2004 | Etienne | B21D 11/12 72/217 |
| 10,441,985 | B2 * | 10/2019 | Vondracek | B21D 11/12 |
| 2016/0175908 | A1 * | 6/2016 | Obinata | B21D 7/024 72/159 |

* cited by examiner

METHOD AND DEVICE FOR BENDING PIPE

CROSS REFERENCE TO RELATED APPLICATIONS

This application is a U.S. national stage application of the International Patent Application No. PCT/JP2016/062943 filed on Apr. 25, 2016, and is based on Japanese Patent Application No. 2015-118775 filed on Jun. 12, 2015, the disclosures of which are incorporated herein by reference.

TECHNICAL FIELD

The present invention relates to a method and a device for three-dimensionally successively bending a pipe in right and left directions or in the right and left directions and up and down directions.

BACKGROUND ART

As a device for bending and processing a pipe, there has been known a device that includes sandwiching means for sandwiching the pipe, and a pair of bending molds for bending the pipe on the free-end side of the pipe sandwiched by the sandwiching means and causes the other bending mold to revolve about one bending mold to bend and process the pipe (for example, PTL 1 and 2).

A device for bending and processing a pipe disclosed in PTL 1 includes sandwiching means for sandwiching the pipe, and a pair of bending molds for bending the pipe on the free-end side of the pipe sandwiched by the sandwiching means, and causes the other bending mold to revolve about the center axis of one bending mold to bend and process the pipe. In order to fix one bending mold and cause the other bending mold to revolve according to a direction in which the pipe is to be bent, the device is so configured that a driving motor is moved to follow the center axis of the one bending mold to rotationally drive the respective bending molds. In this case, there arises an issue that a mechanism for moving the driving motor between the pair of bending molds is needed.

A device for bending and processing a pipe disclosed in PTL 2 causes the other bending mold to revolve about one bending mold out of the bending molds to bend and process the pipe. The device is so configured that an intermittent gear mechanism is interposed between a driving motor and the bending molds, and any one of a pair of bending molds is caused to revolve about the other of the bending molds depending on whether the intermittent gear mechanism is forwardly or reversely rotated, whereby the pipe can be bent in right and left directions. In this case, there arises an issue that the configuration of the intermittent gear mechanism interposed between the driving motor and the pair of bending molds becomes complicated.

CITATION LIST

Patent Literature

[PTL 1] Japanese Patent Application Laid-open No. 2012-30266

[PTL 2] Japanese Patent Application Laid-open No. 2014-94393

SUMMARY OF INVENTION

Technical Problem

FIG. 9 is a schematic plan view showing an example of a pair of bending rolls of such a type of device according to a related art. One end of a pipe W is fixed by a sandwiching device 101, and the other end thereof is sandwiched between a pair of substantially cylindrical bending rolls 102 and 103. In a state indicated by solid lines in FIG. 9, respective center axes 102*a* and 103*a* of the bending rolls 102 and 103 are positioned in a direction perpendicular to the longitudinal direction of the pipe W.

According to the related art in FIG. 9, the other bending roll 103 or 102 is caused to revolve about a center axis 102*a* or 103*a* of one bending roll while the pipe W is sandwiched between the pair of bending rolls 102 and 103. For example, when the pipe W is bent right by $(5/12)\cdot\pi$ (=75°) as shown in FIG. 9, the bending roll 103 is caused to revolve about the center axis 102*a* of the bending roll 102 from a position indicated by a solid line to a position indicated by broken lines by $(5/12)\cdot\pi$ (=75°).

Since the center axis 102*a* of the bending roll 102 serves as the rotating center point of the pair of bending rolls 102 and 103 in the case of FIG. 9, there arises an issue that the pipe W can be bent only in a right direction. In order to allow the pipe W to be bent in both right and left directions, there is a need to provide a driving motor in each of the bending rolls 102 and 103, provide a mechanism for moving one driving motor as disclosed in PTL 1, or transmit the power of one driving motor to each of the bending rolls via an intermittent gear mechanism as disclosed in PTL 2. However, such configurations cause the issues described above. As is clear from these examples, it is not easy to bend a pipe in one of right and left directions and then successively bend the same in an opposite direction with one driving motor in a method or a device for bending the pipe by, while sandwiching one portion of the pipe by a gripping device, causing the other bending roll to relatively revolve about one bending roll.

The present invention has been made in view of the issues residing in the above background arts and has a first problem of proposing a method in which a pipe can be bent in one of right and left directions and then successively bent in an opposite direction with the power of one driving motor relatively easily as a method for bending a pipe in which a pair of substantially cylindrical bending rolls is used and the other bending roll is caused to relatively revolve about one of bending rolls while the pipe is sandwiched by a gripping device, and has a second problem of proposing a device that realizes the method. In addition, the present invention has a third problem of proposing a method in which the pipe can also be successively bent in up and down directions and has a fourth problem of proposing a device that realizes the method.

Solution to Problem

In order to solve the above problems, the present invention provides a method and a device for bending a pipe as described in the following items (1) to (7).

(1) A method for bending a pipe by, while sandwiching one portion of the pipe by a gripping device, sandwiching the other portion of the pipe between a pair of bending rolls each having a groove on a rim thereof and by causing the other bending roll to relatively revolve about one bending roll out of the pair of bending rolls, wherein the pair of bending rolls is held by a common movable frame body, the relative revolution is realized by synchronous movement in which rotating movement for rotating the frame body and lateral movement for moving the frame body in a direction (Y-axis direction) perpendicular to a longitudinal direction (X-axis direction) of the pipe are synchronized with each other, and the movement in the Y-axis direction of the frame body is performed such that a position in the Y-axis direction of a center axis of the one bending roll is held and a position in the X-axis direction of a rotating center point of the rotating movement remains same.

(2) The method for bending the pipe according to the above item (1), wherein the sandwiching device includes a feeding device, and the feeding device feeds the pipe by a length [R(θ−sin θ)] obtained by subtracting a length, which is obtained by multiplying a radius R of the one bending roll by a sine value sin θ of a rotating angle θ (circular method) of the frame body, from a length obtained by multiplying the rotating angle θ by the radius R in the synchronous movement.

(3) The method for bending the pipe according to the above item (1), the method including, after a bending step of bending the pipe right or left, a rotating angle adjusting step of opening one or both of the pair of bending rolls and setting the frame body at a position of a desired rotating angle by the rotating movement for rotating the frame body and the lateral movement for moving the frame body in the Y-axis direction.

(4) The method for bending the pipe according to the above item (3), wherein the bending step of bending the pipe right or left by a desired angle and a feeding step of feeding the pipe by a desired length after the bending step are repeatedly performed in a desired order.

(5) The method for bending the pipe according to the above item (3), wherein the gripping device including the feeding device further includes a rotating device that rotates the pipe about an axis thereof, and the bending step of bending the pipe right or left and a rotating step of adjusting a rotating angle and a position in the Y-axis direction of the frame body such that a direction of a line connecting center axes of both of the bending rolls to each other is oriented in the Y-axis direction by the rotating angle adjusting step and using the rotating device to rotate the pipe about the axis thereof, are repeatedly performed in a desired order.

(6) A device for bending a pipe that has a gripping device for sandwiching one portion of the pipe, and a pair of bending rolls each having a groove in a circumferential direction thereof so as to sandwich the other portion of the pipe therebetween, and that bends the pipe by causing the other bending roll to relatively revolve about the one bending roll out of the pair of bending rolls, the device including: a frame body that holds respective center axes of the pair of bending rolls; a frame body moving device movable in a direction (Y-axis direction) perpendicular to a longitudinal direction (X-axis direction) of the pipe; and a frame body rotating device that rotates the frame body with respect to the frame body moving device, wherein the frame body moving device further includes a control unit that rotates the frame body while holding a position in the X-axis direction of a rotating center point of the rotating movement, moves the frame body in the Y-axis direction so as not to change a position in the Y-axis direction of a center axis of the one bending roll, and controls a rotating angle of the frame body and an amount of lateral movement of the frame body according to a program provided in synchronization.

(7) The device for bending the pipe according to the above item (6), wherein the gripping device includes a feeding device and a rotating device that rotates the pipe about an axis of the pipe, and the control unit controls a feeding amount of the feeding device and a rotating amount of the rotating device.

Advantageous Effects of Invention

In a method and a device for bending a pipe according to the present invention, the pipe can be successively bent in right and left directions and then successively bent in up and down directions with a single driving motor and a relatively simple structure. Accordingly, manufacturing costs and maintenance costs become inexpensive. In addition, since the pipe can be successively bent in the right and left directions and the up and down directions, a shape that is not obtainable or is hardly obtainable by bending processing can be realized by the bending processing. Moreover, when the control of individual steps such as bending the pipe right, bending the pipe left, feeding the pipe, controlling the positions of bending rolls, bending the pipe upward, and bending the pipe downward is implemented into subroutines by computer control, the preparation of the processing can be performed easily and in a short period of time and can be changed easily and in a short period of time.

DESCRIPTION OF EMBODIMENTS

Hereinafter, an embodiment of a method and a device for bending a pipe according to the present invention will be described in detail based on the drawings.

In the method and the device according to the embodiment, the pipe is gripped, fed, and rotated by a gripping device. Therefore, the gripping device is openable/closable, attaches/detaches the pipe in its opening state, and applies bending processing or the like to the pipe in its closed state. In addition, the pipe is fed in its longitudinal direction by a feeding device. Moreover, the pipe may be rotated about its axis by a rotating device.

Note that since the specific configurations of the opening/closing mechanism of the gripping device, the feeding mechanism of the feeding device, and the rotating mechanism of the rotating device in the embodiment are known arts for skilled persons, can be designed in the specification, and do not constitute the essences of the present invention, their specific descriptions will be omitted.

Figure 1:
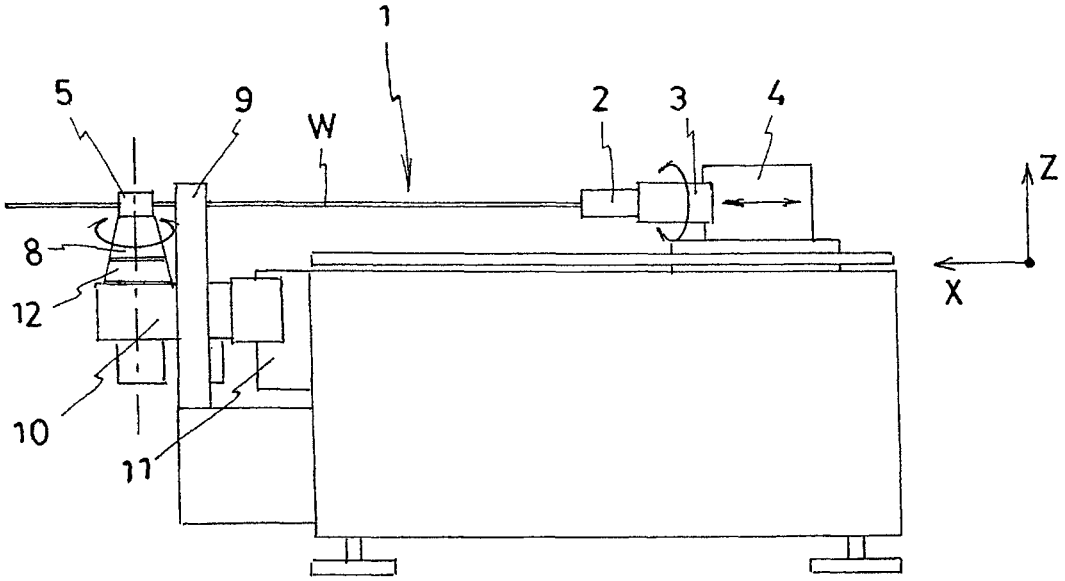
FIG. 1 is a conceptual side view of an example of a device that performs a method for bending a pipe according to the present invention.
Figure 2:
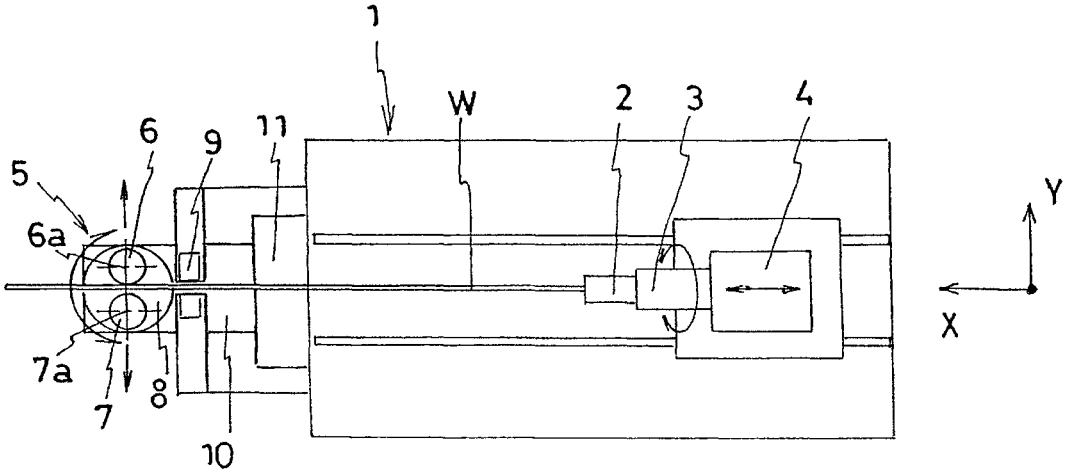
FIG. 2 is a conceptual plan view of the device shown in FIG. 1.
Figure 3:
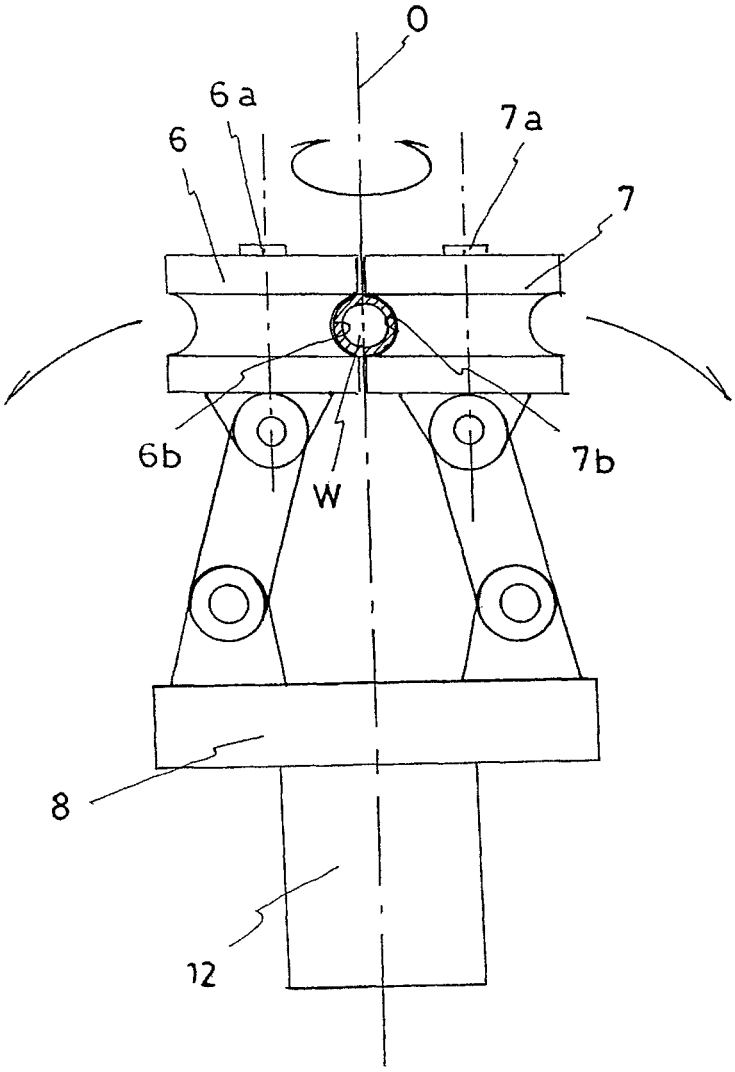
FIG. 3 is a conceptual configuration view of a pair of bending rolls in the device shown in FIG. 1.

In FIGS. 1 to 3, an embodiment of the device that performs the method according to the present invention is conceptually shown. A device 1 includes a gripping device 2 that grips a pipe W, a rotating device 3, and a feeding device 4. FIGS. 1 and 2 do not intend to show the arrangements or the like of the devices, but the devices can be modified in various ways. That is, the arrangements do not limit the technical scope of the invention, but the devices may be so arranged that the pipe can be gripped, fed, and rotated. Skilled persons in the field can design the arrangements of the devices as described above as an ordinary design process.

As shown in FIGS. 1 and 2, one portion, for example, the vicinity of one end of the pipe W is gripped by the gripping device 2, and the other portion, for example, the vicinity of the other end thereof is sandwiched between a pair of bending rolls 5. The pair of bending rolls is composed of a first roll 6 and a second roll 7, and the first and second rolls 6 and 7 are attached to a frame body 8. At the intermediate position between the gripping device 2 and the first and second rolls 6 and 7, an intermediate holding device 9 that holds the pipe W is provided.

FIG. 3 shows a state in which the pipe W is sandwiched between respective grooves 6*b* and 7*b* of the first and second rolls 6 and 7. That is, in the state shown in FIG. 3, the first and second rolls 6 and 7 are closed. The first and second rolls 6 and 7 are needed to be opened to attach/detach the pipe W, and include a bending roll opening/closing mechanism therefor. The bending roll opening/closing mechanism can be realized when the distance between center axes 6*a* and 7*a* is changed while holding the parallel state between the center axes 6*a* and 7*a* as ordinarily performed. However, the bending roll opening/closing mechanism may be realized by other methods, for example, a method as disclosed in PTL 1. Skilled persons employ any type of opening/closing mechanism as an ordinary design process. The bending rolls 6 and 7 are attached to the frame body 8 via the roll opening/closing mechanism.

As shown in FIGS. 1 and 2, the frame body 8 is mounted on a frame body moving device 10 that reciprocates in a direction (hereinafter called a Y-axis direction where necessary) perpendicular to the longitudinal direction (hereinafter called an X-axis direction where necessary) of the pipe W, and the frame body 8 is configured to be rotatable with respect to the frame body moving device 10. That is, the frame body moving device 10 moves along a Y-axis guide 11 extending in the Y-axis direction, and the frame body 8 rotates with respect to the frame body moving device 10. In order to rotate the frame body 8 with respect to the frame body moving device 10, a frame body rotating device 12 is arranged between the frame body moving device 10 and the frame body 8. The center of the rotation of the frame body 8 is preferably set at a point O at which the pair of bending rolls 6 and 7 contacts each other. The center may be set at a point on a line connecting the center axes 6*a* and 7*a* to each other or may be set at other points on the frame body 8, but a formula to perform control becomes slightly troublesome in this case. Note that the point O at which the bending rolls 6 and 7 contact each other is not limited to a case in which the bending rolls 6 and 7 contact each other but also includes a case in which the bending rolls 6 and 7 indirectly contact each other, so long as the pipe W is sandwiched between the bending rolls 6 and 7.

In the present invention, a movement amount of the reciprocation of the frame body moving device 10, a rotating amount of the rotating movement of the frame body rotating device 12, and a feeding amount of the pipe W by the feeding device 4 are linked to each other as will be described below and controlled by a control unit not shown. The control will be described below using FIGS. 4 and 5.

Figure 4:
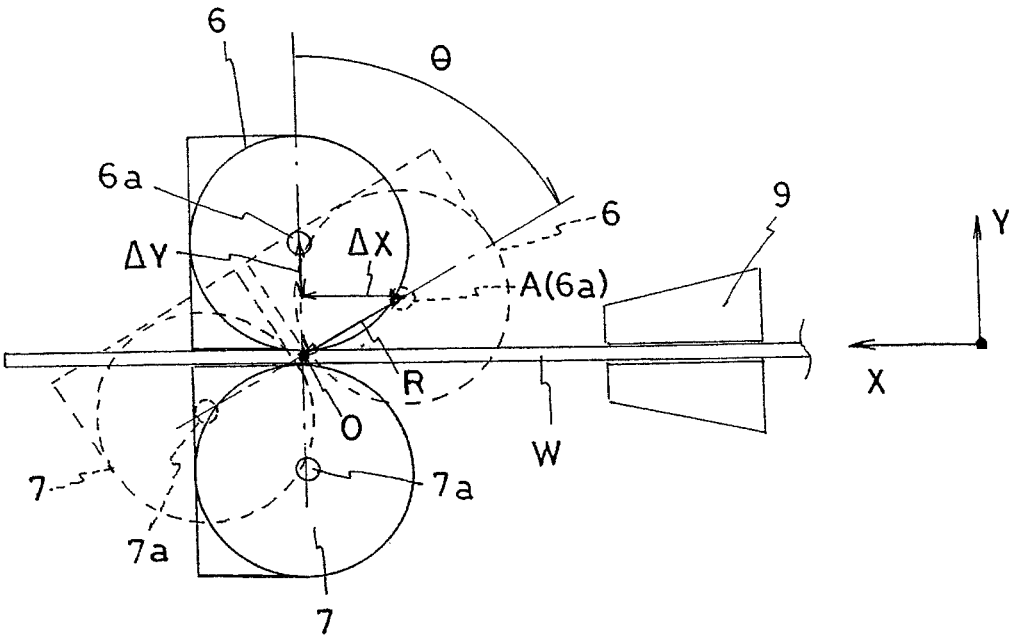
FIG. 4 is an explanatory view for explaining how to control a rotating angle of the pair of bending rolls, a movement amount in a Y-axis direction of the pair of bending rolls, and a feeding amount of the pipe so as to be linked to each other in an imaginary case in which the pair of bending rolls is only rotated and is not moved in the Y-axis direction.

In FIG. 4, solid lines conceptually show the pair of bending rolls 6 and 7 sandwiching the pipe W therebetween in a state in which the center axes 6*a* and 7*a* of the bending rolls 6 and 7 are oriented in the direction (Y-axis direction) perpendicular to the longitudinal direction (X-axis direction) of the pipe W. In this state, the pipe W serves as a tangential line common to the bending rolls 6 and 7. In order to make the following description clear, it is defined that the normal direction of an X-axis is a direction from the gripping device 2 to the bending rolls 6 and 7, and that the normal direction of a Y-axis is a direction from the center axis 6*a* to the center axis 7*a* indicated by solid lines in FIG. 4. In addition, it is defined that the radii of the bending rolls 6 and 7 are indicated by R.

In FIG. 4, broken lines show an imaginary state in which the pair of bending rolls 6 and 7 is rotated about the point O by an angle θ (circular method) with the pipe W sandwiched therebetween in a state in which the position of the point O at which the bending rolls 6 and 7 on the line connecting the center axes 6*a* and 7*a* to each other contact each other is fixed. In this case, the center axis 6*a* of the bending roll 6 is moved to a point A in FIG. 4. A moving amount of the position of the center axis 6*a* when the bending rolls 6 and 7 are rotated about the point O by the angle θ can be separately analyzed as an X-direction component and a Y-direction component. The X-direction component ΔX and the Y-direction component ΔY with a change in the position of the center axis 6*a* are as follows.

$$\Delta X = R \sin \theta$$

$$\Delta Y = R(1 - \cos \theta)$$

In the embodiment, the frame body 8 is rotated by the frame body rotating device 12 in a state in which the position in the X-axis direction of the rotating center point O is fixed, whereby the pair of bending rolls 6 and 7 is rotated about the rotating center point O. In the arrangements of the solid lines in FIG. 5, the rotating center point O is a point at which the bending rolls 6 and 7 on a line connecting the center axes 6*a* and 7*a* to each other contact each other. Concurrently with the rotating movement, the pair of bending rolls 6 and 7 is moved in the positive direction of the Y-axis. The movement of the pair of the bending rolls 6 and 7 intend to cancel the movement in the Y-axis direction of the center axis 6*a* of the bending roll 6. Such movement can be realized in such a manner that the frame body moving device 10 movable in the Y-axis direction along the Y-axis guide 11 whose position in the X-axis direction relative to the gripping device is fixed is moved in the Y-axis direction and that the frame body 8 to which the pair of bending rolls 6 and 7 are attached can be rotated about the rotating center point O by the frame body rotating device 12 provided on the frame body moving device 10. By the movement in the Y-axis direction of the frame body moving device 10 as described above, the movement of the center axis 6*a* of the bending roll 6 when rotating in the Y-axis direction can be cancelled.

Figure 5:
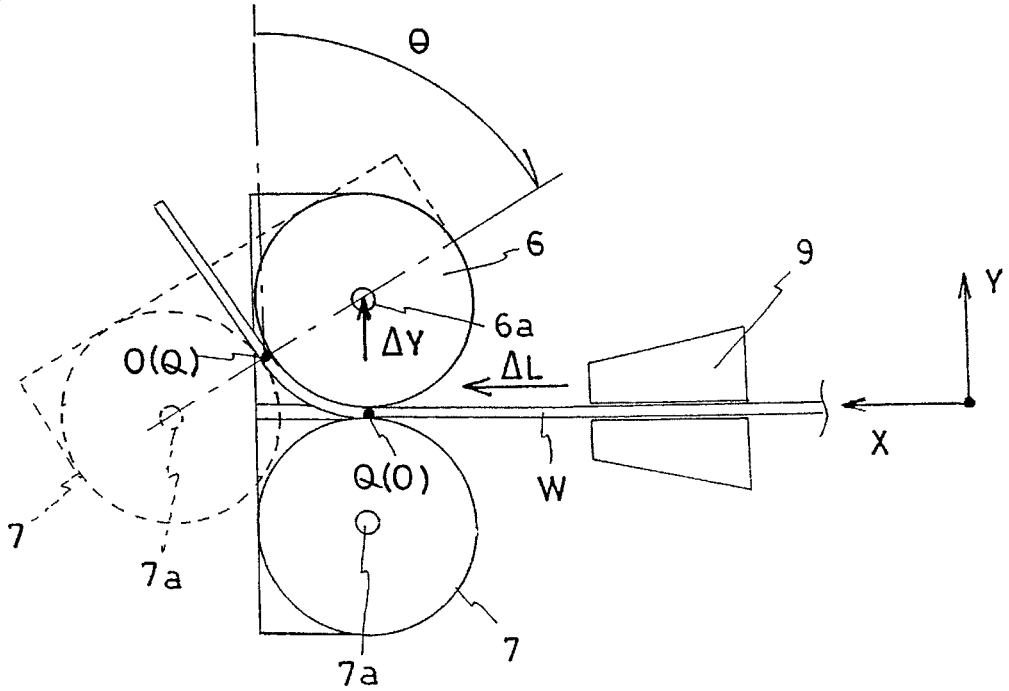
FIG. 5 is an explanatory view for explaining how to control a rotating angle of the pair of bending rolls, a movement amount in the Y-axis direction of the pair of bending rolls, and a feeding amount of the pipe so as to be linked to each other in a case in which the rotation and the movement in the Y-axis direction of the pair of bending rolls are synchronously performed according to the present invention.

FIG. 5 shows a state (indicated by solid lines) before and a state (indicated by broken lines) after the rotation and movement described above are performed. In FIG. 5, the solid lines conceptually show, like the solid lines in FIG. 4, the pair of bending rolls 6 and 7 sandwiching the pipe W therebetween in a state in which the respective center axes 6*a* and 7*a* of the bending rolls 6 and 7 are positioned in a direction (Y-axis direction) perpendicular to the longitudinal direction (X-axis direction) of the pipe W. In this state, the pipe W is a tangential line common to the bending rolls 6 and 7.

In FIG. 5, the broken lines show a state in which the pair of bending rolls 6 and 7 is rotated about a rotating center point O by an angle θ (circular method) with the pipe W sandwiched therebetween and in which the pair of bending rolls 6 and 7 is moved by ΔY[=R(1−cos θ)] in the normal direction of the Y-axis so as to cancel a movement amount in the Y-axis direction of the center axis 6*a* of the bending roll 6 accompanied by the rotation. The rotating center point O is moved to the point O in FIG. 5. When movement amounts of the positions of the center axes 6*a* and 7*a* are separately analyzed as an X-direction component and a Y-direction component based on the movement of the pair of bending rolls 6 and 7 in the Y-axis direction, the X-direction component Δx and the Y-direction component Δy with a change in the position of the center axis 6*a* are as follows.

$$\Delta x = R \sin \theta$$

$$\Delta y = R(1-\cos \theta) - R(1-\cos \theta) = 0$$

The comparison between the arrangement of the solid lines and the arrangement of the broken lines in FIG. 5 shows that the position in the Y-axis direction of the rotating center point O of the pair of bending rolls 6 and 7 is changed but the position in the Y-axis direction of the center axis 6*a* of the bending roll 6 remains the same. In other words, the bending roll 6 contacts the pipe W at all times. The contact point is indicated by Q. In addition, since the pair of bending rolls 6 and 7 is rotated about the rotating center point O, the bending rolls 6 and 7 contact each other at the rotating center point O at all times and the pipe W is bent in the direction of the common tangential line. A length along the rims of the bending rolls between the rotating center point O and the contact point Q is indicated by Rθ.

When compared with the position in the X-axis direction of the center axis 6*a* of the bending roll 6 at the position indicated by the solid line, the position in the X-axis direction of the center axis 6*a* of the bending roll 6 at the position indicated by the broken lines is moved in a negative direction by R sin θ relative to the rotating center point O. That is, a distance in the X-axis direction between the position of the rotating center point O of the solid line and the position of the contact point Q of the broken lines is R sin θ. Further, a length along the rim of the bending roll 6 from the position of the contact point Q of the broken lines to the rotating center point O of the solid line is Rθ. When the position in the X-axis direction of the rotating center point O is fixed, the pipe is fed by a difference ΔL, i.e., ΔL=Rθ−R sin θ=R(θ−sin θ) from the feeding device 4.

In the method and the device for bending the pipe according to the present invention, the state indicated by the solid lines is changed to the state indicated by the broken lines in FIG. 5 by adjusting a rotating angle θ at which the frame body 8 to which the pair of bending rolls 6 and 7 is attached is rotated, a movement amount ΔY at which the frame body 8 is moved in the Y-axis direction, and a feeding amount ΔL at which the pipe is fed from the feeding device 4 as described above, and the control of the adjustment can be realized by control using a computer not shown.

FIG. 5 shows a case in which the pipe W is bent right, and the frame body 8 is rotated clockwise about the point O serving as the contact point between the pair of bending rolls 6 and 7. When the pipe W is bent left, the frame body 8 is rotated counterclockwise about the same point O while the rotating angle θ at which the frame body 8 to which the pair of bending rolls 6 and 7 is attached is rotated, the movement amount ΔY at which the frame body 8 is moved in the Y-axis direction, and the feeding amount ΔL at which the pipe is fed from the feeding device 4 as described above are adjusted. That is, in both cases, the power of a driving motor not shown is transmitted to a driving shaft not shown and provided at the rotating center point O to normally rotate or reversely rotate the driving shaft, whereby the bending direction of the pipe W can be adjusted.

Figure 6:
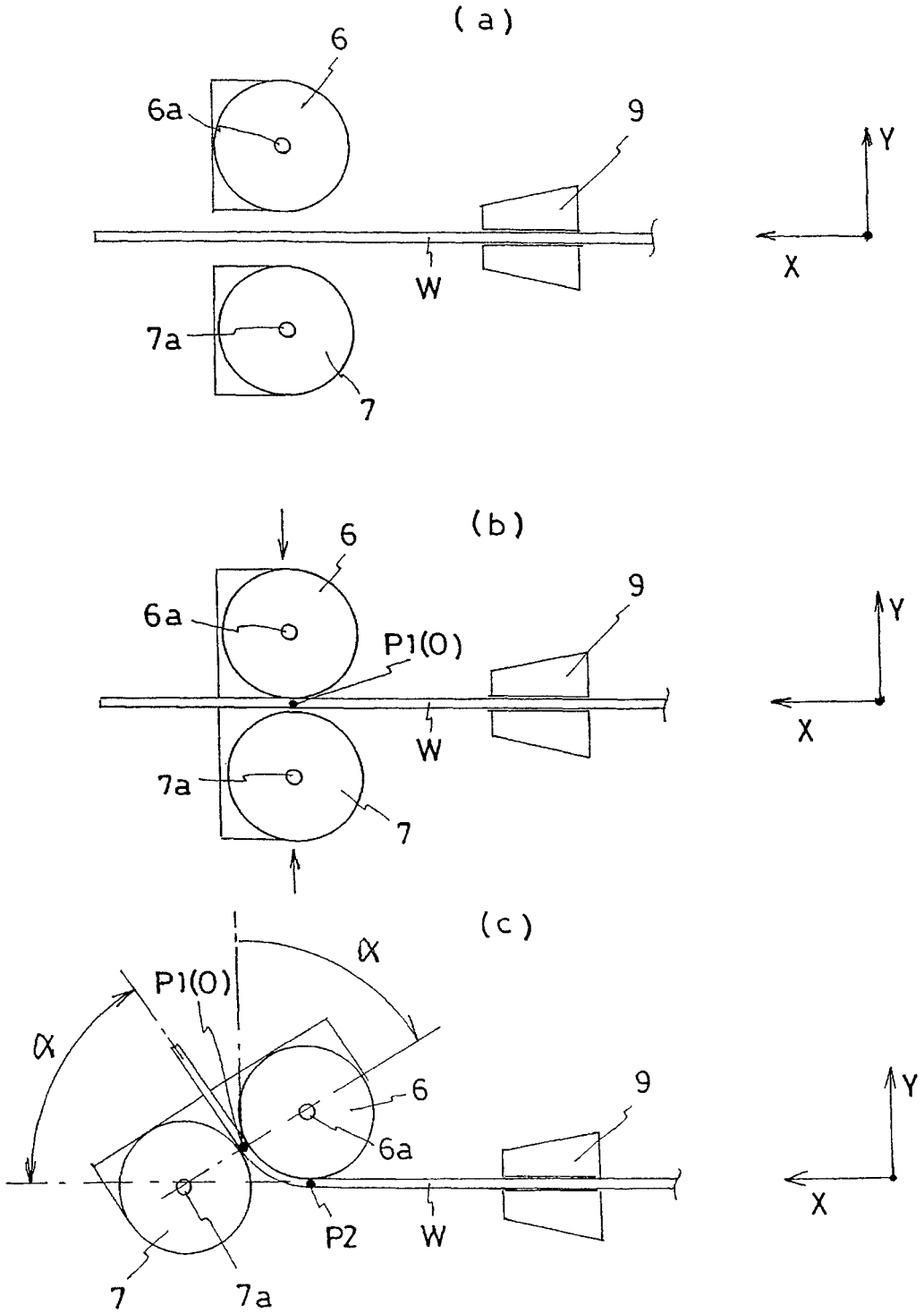
FIG. 6 is a view schematically showing the step of bending the pipe right.
Figure 7:
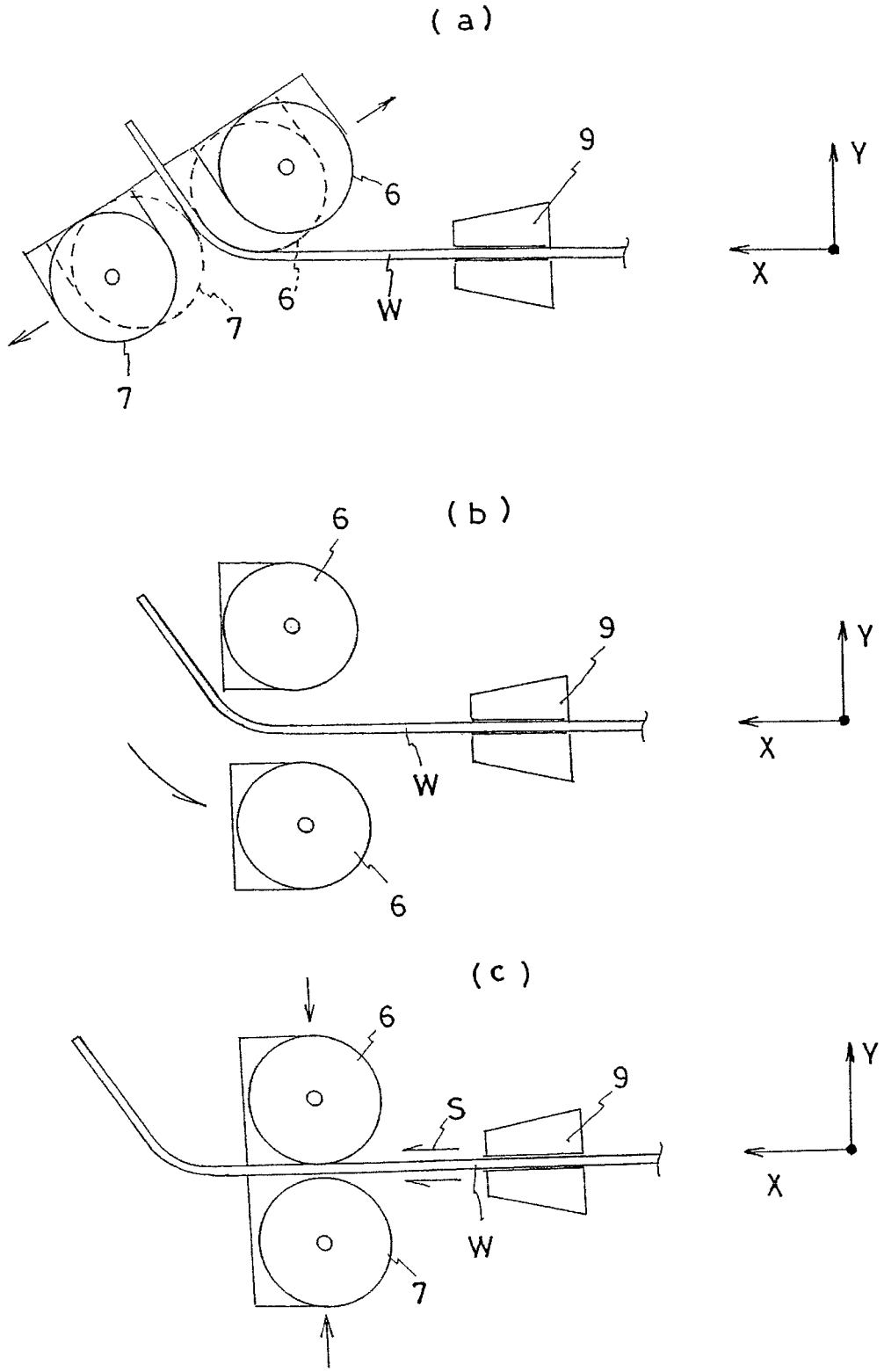
FIG. 7 is a view schematically showing part of the step of bending the pipe left after bending the same right.
Figure 8:
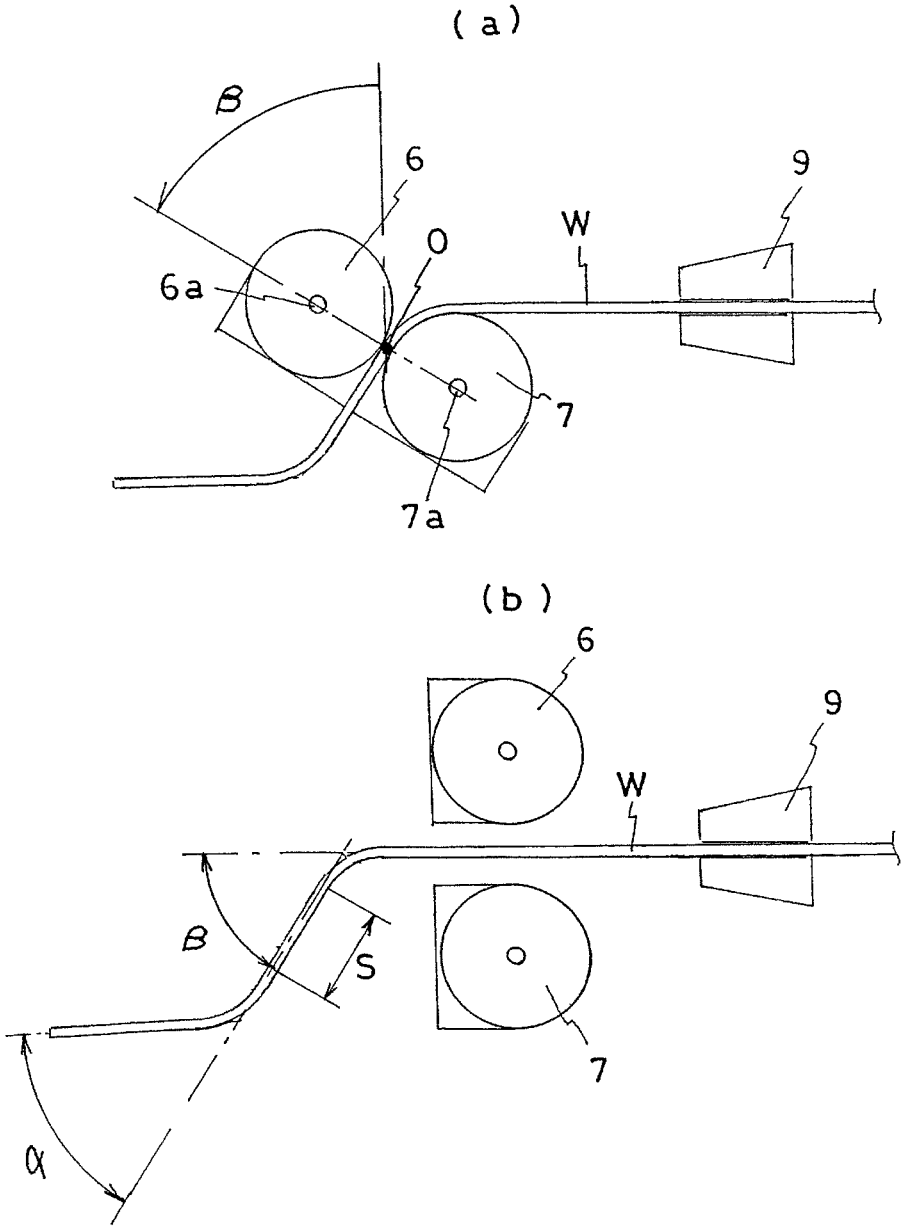
FIG. 8 is a view schematically showing part of the step of bending the pipe left.
Figure 9:
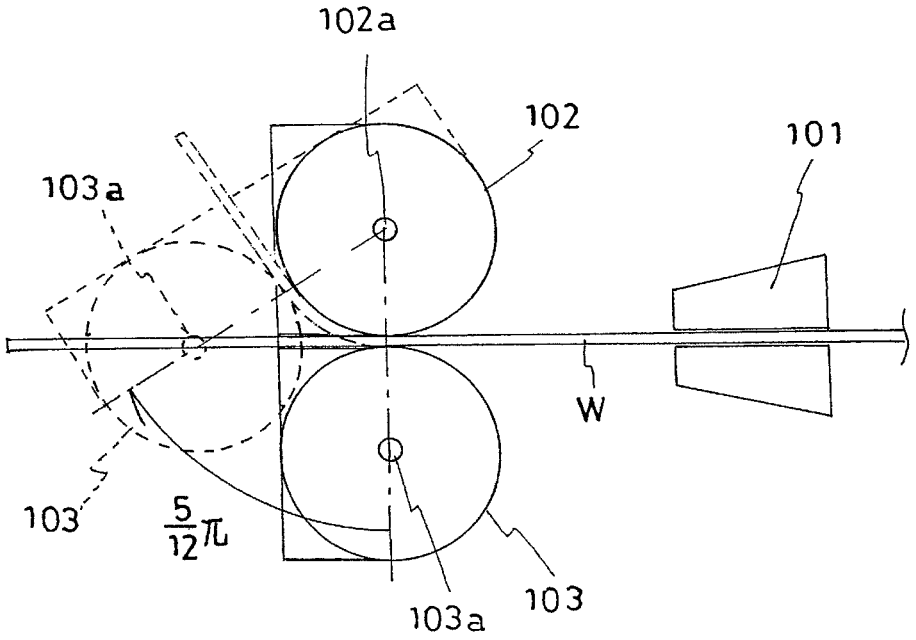
FIG. 9 is a conceptual plan view of an example of a pair of bending rolls of a bending and processing device according to a related art.

FIGS. 6 to 8 are views schematically showing the step of bending the pipe W left after bending the same right. In the figures, only the relative relationship between the pair of bending rolls 6 and 7 and the pipe W is conceptually shown. In order to prevent FIGS. 6 to 8 from being complicated, the frame body 8 is rotated at a rotating angle α or β of a line connecting the respective center axes 6*a* and 7*a* of the first and second bending rolls 6 and 7 to each other.

FIG. 6(*a*) shows a state in which the first and second bending rolls 6 and 7 are opened to make the pipe W fed from the intermediate holding device 9 to pass through. FIG. 6(*b*) shows a state in which the pipe W is sandwiched between the first and second bending rolls 6 and 7 at a contact point P1. FIG. 6(*c*) shows a bending step and shows a state in which the pair of bending rolls 6 and 7 is rotated by the angle α about the rotating center point O with the pipe W sandwiched therebetween at the contact point P1 while being moved in the Y-axis direction so as to cancel a change in the position in the Y-axis direction of the center axis 6*a* of the first bending roll 6 to bend the pipe W right. Note that since the frame body moving device 10 is moved only in the Y-axis direction at this time, the position in the X-axis direction of the rotating center point O is not moved. In order to cancel the movement in the Y-axis direction of the first bending roll 6, the pair of bending rolls 6 and 7 is moved in the Y-axis direction by R(1−cos α). In other words, the first roll 6 contacts the pipe W between the intermediate holding device 9 and the bending rolls 6 and 7 at a point P2 at all times. However, the first roll 6 does not necessarily actually physically contact the pipe W at the point P2.

In the state of FIG. 6(*c*), the pipe W is bent right by the angle α. Since the pair of bending rolls 6 and 7 is not allowed to be restored to their initial positions in this state, they need to be opened.

FIGS. 7(*a*) and 7(*b*) show a rotating angle adjusting step. FIG. 7(*a*) shows a state in which the first and second rolls 6 and 7 are opened from their positions indicated by broken lines (in the same arrangement as that shown in FIG. 6(*c*)) to positions indicated by solid lines to restore the first and second rolls 6 and 7 to the initial positions and feed the pipe W. The bending rolls 6 and 7 are both opened in the illustrated example, but only one of the bending rolls 6 and 7 may be opened where necessary. In this state, the feeding of the pipe W, the reverse rotation of the first and second rolls 6 and 7, or the like is performed to adjust a rotating angle of the pair of bending rolls 6 and 7. FIG. 7(*b*) shows a state in which the arrangements of the first and second rolls 6 and 7 are restored to the state shown in FIG. 6(*a*). FIG. 7(*c*) shows a state in which the pipe W is fed by a distance S and then the pair of bending rolls 6 and 7 is closed.

FIG. 8(*a*) shows a state in which the pair of bending rolls 6 and 7 is rotated left by the angle β about a rotating center point O to successively bend the pipe W left while being moved by R(1−cos β) in the Y-axis direction so as to cancel the movement in the Y-axis direction of the center axis 7*a* of the second roll 7. Subsequently, as shown in FIG. 8(*b*), the arrangements of the first and second rolls 6 and 7 can be restored to their initial states by the same operation as that shown in FIG. 7(*a*). Thus, the pipe can be freely bent by combining the bending of the pipe right and left and the feeding operation of the pipe together. FIG. 8(*b*) shows a state in which the pipe is first bent right by the angle α, then fed by the length S, and bent left by the angle β.

In a case in which the rotating device 3 is attached to the gripping device 2, the pipe W is rotated about its axis by the rotating device 3 and then can be bent right or left after the pipe W is put in the state shown in FIG. 6(*a*). As a result, bending having a shape obtained by freely combining right bending, left bending, upward bending, and downward bending together can be realized.

The control unit (or controller) not shown performs control to move the gripping device 2, the rotating device 3, the feeding device 4, a rotating angle of the frame body 8, and the frame body 8 in the Y-axis direction to cancel the movement of the position of the center axis of the first or second bending roll, but the control system of the control unit (or controller) can be easily conceived by technicians as skilled persons, Therefore, the description of the control system will be omitted. On this occasion, a program divided into the subroutine of bending the pipe right (left) at any angle, the subroutine of feeding the pipe having any size without being bent, the subroutine of the restoring the first and second bending rolls from any position to their initial positions, the subroutine of rotating the pipe about its axis, or the like is prepared and the subroutines are appropriately combined together, whereby a workpiece having a complicated shape can be easily manufactured.

The embodiment of the method and the device for bending the pipe according to the present invention is described above, but the present invention is not limited to the embodiment. As will be repeatedly described below, designing the opening/closing mechanism of the gripping device 2, the feeding mechanism of the feeding device 4, the rotating mechanism of the rotating device 3, the shapes of the pair of bending rolls, the shape of the Y-axis guide 11, the mechanism of the frame body moving device 10, the mechanism of the frame body rotating device 12, the structure of the frame body 8, their attachment relationships, and the program of the control unit constituting the present invention to realize the present invention falls within the technical scope of the present invention.

INDUSTRIAL APPLICABILITY

According to a method and a device for bending a pipe according to the present invention, it is possible to successively bend the pipe in right and left directions and successively bend the same in up and down directions with a single driving motor and a relatively simple structure, they are widely available as a method and a device for bending a pipe used for automobiles, household appliances, or the like.

REFERENCE SIGNS LIST

1 Bending device
2 Gripping device
3 Feeding device
4 Rotating device
5 Pair of bending rolls
6 First bending roll
6*a* Center axis
6*b* Groove
7 Second bending roll
7*a* Center axis
7*b* Groove
8 Frame body
9 Intermediate holding device
10 Frame body moving device
11 Y-axis guide
12 Frame body rotating device
O Rotating center point
W Pipe

The invention claimed is:

1. A method for bending a pipe, the method comprising:

sandwiching a first portion of the pipe by a gripping device, sandwiching a second portion of the pipe at a rotating center point of a frame body, the frame body including first and second bending rolls, each of the first and the second bending rolls having a center axis fastened to the frame body and a rim with a groove, the second portion of the pipe being sandwiched between the first and second bending rolls at a contact point corresponding to the rotating center point of the frame body, and bending the pipe by a synchronous movement including rotating the frame body about the rotating center point of the frame body while concurrently moving the frame body in a lateral direction (Y-axis direction) which is perpendicular to a longitudinal direction (X-axis direction) of the pipe, thereby causing the second bending roll to rotate about the center axis of the first bending roll, wherein before the bending, the rotating center point of the frame body and the center axis of the first bending roll each have an initial X-axis position in the X-axis direction and an initial Y-axis position in the Y-axis direction, and wherein the bending by the synchronous movement is performed without moving the initial Y-axis position of the center axis of the first bending roll and without moving the initial X-axis position of the rotating center point of the frame body.

2. The method for bending the pipe according to claim 1, wherein after the bending step of bending the pipe, adjusting a rotating angle by opening one or both of the first bending roll and the second bending roll of the pair of bending rolls, and setting the frame body at a position of a desired rotating angle for rotating the frame body and laterally moving the frame body in the Y-axis direction differently from that used in the bending step.

3. The method for bending the pipe according to claim 2, further comprising a feeding step of feeding the pipe by a desired length after the bending step, wherein the bending step and the feeding step are repeatedly performed in a desired order.

4. The method for bending the pipe according to claim 2, wherein the gripping device includes a rotating device that rotates the pipe about an axis of the pipe, and the method further comprises a step of using the rotating device to rotate the pipe about the axis thereof, wherein the adjusting the rotating angle step comprises adjusting a position in the Y-axis direction of the frame body and rotating the frame body, such that a direction of a line connecting center axes of both of the bending rolls to each other is oriented in the Y-axis direction, wherein the bending step, the adjusting the rotating angle step and the step of using the rotating device are repeatedly performed in a desired order.

5. A method for bending a pipe, the method-comprising:

sandwiching a first portion of the pipe by a gripping device, sandwiching a second portion of the pipe between a pair of bending rolls mounted on a frame body at a rotating center point of the frame body, the second portion of the pipe including a contact point corresponding to the rotating center point of the frame body, the pair of bending rolls including a first bending roll and a second bending roll, each bending roll having a center axis and a rim with a groove, and bending the pipe by a synchronous movement including rotating the frame body about the rotating center point of the frame body while moving the frame body in a lateral direction (Y-axis direction) which is perpendicular to a longitudinal direction (X-axis direction) of the pipe, thereby causing the second bending roll to revolve about and relative to the first bending roll, wherein before the bending, the rotating center point of the frame body and the center axis of the first bending roll each have an initial X-axis position in the X-axis direction and an initial Y-axis position in the Y-axis direction, wherein the bending by the synchronous movement is performed without moving the initial Y-axis position of the center axis of the first bending roll and without moving the initial X-axis position of the rotating center point of the frame body, and wherein the gripping device includes a feeding device, and the method includes:

feeding the pipe by a length equal to ΔL using the feeding device, wherein $\Delta L=[R(\theta-\sin\theta)]=R\theta-R\sin\theta$, and R sin θ is a length obtained by multiplying a radius R of the first bending roll by a sine value sin θ of a rotating angle θ (circular method) of the frame body, and Rθ is a length obtained by multiplying the rotating angle θ by the radius R in the synchronous movement of the frame body.

6. An apparatus for bending pipe, comprising:

a gripping device configured to sandwich one portion of a pipe to be bent;

a frame body including a pair of bending rolls including first and second bending rolls, the first and second bending rolls each having a center axis fastened to the frame body and a groove extending in a circumferential direction around each bending roll, the pair of bending rolls being configured to sandwich another portion of the pipe to be bent between the first and second bending rolls at a rotating center point of the frame body;

a frame body moving device attached to the frame body and configured to move the frame body in a direction (Y-axis direction) that is perpendicular to a longitudinal direction (X-axis direction) of the pipe to be bent;

a frame body rotating device attached to the frame body and configured to rotate the frame body with respect to the frame body moving device; and the frame body in combination with the frame body moving device and the frame body rotating device being configured to bend the pipe to be bent by causing the second bending roll to revolve relative to the first bending roll and about the first bending roll, wherein the frame body moving device includes a controller configured to control the frame body rotating device and the frame body moving device so that the second bending roll fastened to the frame body revolves around the center axis of the first bending roll and bends the pipe to be bent in the circumferential direction around the first bending roll, wherein the rotating center point of the frame body and the center axis of the first bending roll each have an initial X-axis position in the X-axis direction and an initial Y-axis position in the Y-axis direction, and wherein the controller is configured to rotate and simultaneously to laterally move the frame body in the Y-axis direction without changing the initial X-axis position of the rotating center point of the frame body and without changing the initial Y-axis position of the center axis of the first bending roll.

7. The apparatus for bending pipe according to claim 6, wherein the gripping device includes a feeding device and a rotating device that rotates the pipe to be bent about an axis thereof, and the controller is configured to control a feeding amount of the pipe to be bent by the feeding device and to control a rotating amount of the rotating device.

* * * * *